US007556661B2

(12) United States Patent
Jeong et al.

(10) Patent No.: US 7,556,661 B2
(45) Date of Patent: Jul. 7, 2009

(54) DUST COLLECTION UNIT AND VACUUM CLEANER WITH SAME

(75) Inventors: Hoi Kil Jeong, Changwon-si (KR); Geun Bae Hwang, Changwon-si (KR); Young Jong Kim, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 541 days.

(21) Appl. No.: 11/232,858

(22) Filed: Sep. 23, 2005

(65) Prior Publication Data

US 2006/0137306 A1 Jun. 29, 2006

(30) Foreign Application Priority Data

Dec. 27, 2004 (KR) ..... 10-2004-0113380

(51) Int. Cl.
*B01D 45/12* (2006.01)

(52) U.S. Cl. ..... 55/343; 55/416; 55/429; 55/DIG. 3

(58) Field of Classification Search ..... 55/414, 55/416, 429, 343, DIG. 3
See application file for complete search history.

(56) References Cited

U.S. PATENT DOCUMENTS 2,010,128 A * 8/1935 Arnold ..... 209/710
6,679,930 B1 * 1/2004 An et al. ..... 55/337
7,361,200 B2 * 4/2008 Oh et al. ..... 55/343

FOREIGN PATENT DOCUMENTS

| | | |
|---|---|---|
| GB | 2 399 780 A | 9/2004 |
| RU | 2 236 813 C2 | 9/2004 |
| WO | WO 99/49978 | 10/1999 |
| WO | WO 00/64321 | 11/2000 |

* cited by examiner

*Primary Examiner*—Robert A Hopkins
(74) *Attorney, Agent, or Firm*—McKenna Long & Aldridge

(57) ABSTRACT

A dust collection unit for a vacuum cleaner includes a first filtering chamber filtering relatively large foreign objects, a second filtering chamber filtering relatively small foreign objects when air exhausted from the first filtering chamber is introduced into the second filtering chamber, an exhaust member disposed above the filtering chambers to guide airflow, a storing chamber disposed under the filtering chambers to store the foreign objects filtered in the filtering chambers, a sealing member sealing bottoms of the filtering chambers, and a rectifying unit formed on an exhaust side of the second filtering chamber to rectify airflow, thereby reducing noise generated by the airflow.

16 Claims, 9 Drawing Sheets

DUST COLLECTION UNIT AND VACUUM CLEANER WITH SAME

BACKGROUND OF THE INVENTION

1. Field of the Invention

The present invention relates to a vacuum cleaner, and particularly, to a dust collection unit for a vacuum cleaner, which can reduce airflow noise generated by a cyclone airflow. More particularly, the present invention relates to a dust collection unit for a vacuum cleaner, which can reduce noise generated when air flows with a high speed in a multi-cyclone dust collection unit, thereby attenuating user's unpleasant sensation.

2. Description of the Related Art

A vacuum cleaner is used to clean a room or other spaces by sucking air containing foreign objects and filtering the foreign object using vacuum pressure generated therein. In order to filter the foreign objects contained in the sucked air, a dust collection unit with a filtering unit is provided in the vacuum cleaner.

The filtering unit is classified into a porous filter formed of porous material and a cyclone type filter. The porous filter formed of porous material is designed to filter the foreign objects contained in air while the air passes through the filter. The cyclone type filter is designed to filter the foreign objects using cyclone airflow. In order to reuse the porous filter, a user cleans the filter to remove the foreign objects clogged in the filter. It is very inconvenient to clean the filter. Furthermore, when a large amount of the foreign objects are clogged, the porous filter cannot be reused. Since the cyclone type filter is designed to remove the foreign objects from the air by a rotational air current generated by cyclone airflow, the clogging of the foreign objects in the filter is not incurred. Due to this reason, in recent years, cyclone type filter has been widely used.

In recent years, a multi-cyclone type dust collection unit, in which the cyclone unit is provided in plurality to generate a plurality of cyclone airflows so that the foreign objects contained in the air can be filtered by only the cyclone airflows, has been developed. The multi-cyclone airflows improve the foreign object removal efficiency. In addition, since there is no need to additionally provide the porous filter in the dust collection unit, the clogging problem is not incurred.

However, since the multi-cyclone type dust collection unit is designed to remove the foreign objects using only the cyclone airflows, a plurality of airflow passages should be formed in the collection unit and the passages are in a tangle.

Particularly, when the foreign objects are filtered by a plurality of small cyclone airflows, high frequency noise is generated due to the high speed airflow.

SUMMARY OF THE INVENTION

Accordingly, the present invention is directed to a dust collection unit for a vacuum cleaner that substantially obviates one or more problems due to limitations and disadvantages of the related art.

An object of the present invention is to provide a dust collection unit, which is designed to reduce airflow noise generated when air flows with high speed, thereby attenuating user's unpleasant sensation.

Another object of the present invention is to provide a dust collection unit, which can suppress high frequency noise generated by airflow in a relatively small-diameter tube of the dust collection unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dust collection unit for a vacuum cleaner, including: a first filtering chamber filtering relatively large foreign objects; a second filtering chamber filtering relatively small foreign objects when air exhausted from the first filtering chamber is introduced into the second filtering chamber; an exhaust member disposed above the filtering chambers to guide airflow; a storing chamber disposed under the filtering chambers to store the foreign objects filtered in the filtering chambers; a sealing member sealing bottoms of the filtering chambers; and a rectifying unit formed on an exhaust side of the second filtering chamber to rectify airflow, thereby reducing noise generated by the airflow.

In another aspect of the present invention, there is provided a dust collection unit for a vacuum cleaner, including: a first filtering chamber filtering relatively large foreign objects; a second filtering chamber filtering relatively small foreign objects when air exhausted from the first filtering chamber is introduced into the second filtering chamber; and a rectifying unit formed on an exhaust side of the second filtering chamber to rectify airflow, thereby reducing noise generated by the airflow.

In still another aspect of the present invention, there is provided a dust collection unit for a vacuum cleaner, including a first filtering chamber filtering relatively large foreign objects; a second filtering chamber filtering relatively small foreign objects when air exhausted from the first filtering chamber is introduced into the second filtering chamber; an exhaust member disposed above the filtering chambers to guide airflow; a storing chamber disposed under the filtering chambers to store the foreign objects filtered in the filtering chambers; and a rectifying unit formed on an exhaust side of the second filtering chamber to rectify airflow, thereby reducing noise generated by the airflow.

According to the present invention, noise generated in the dust collection unit can be reduced, thereby attenuating user's unpleasant sensation.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
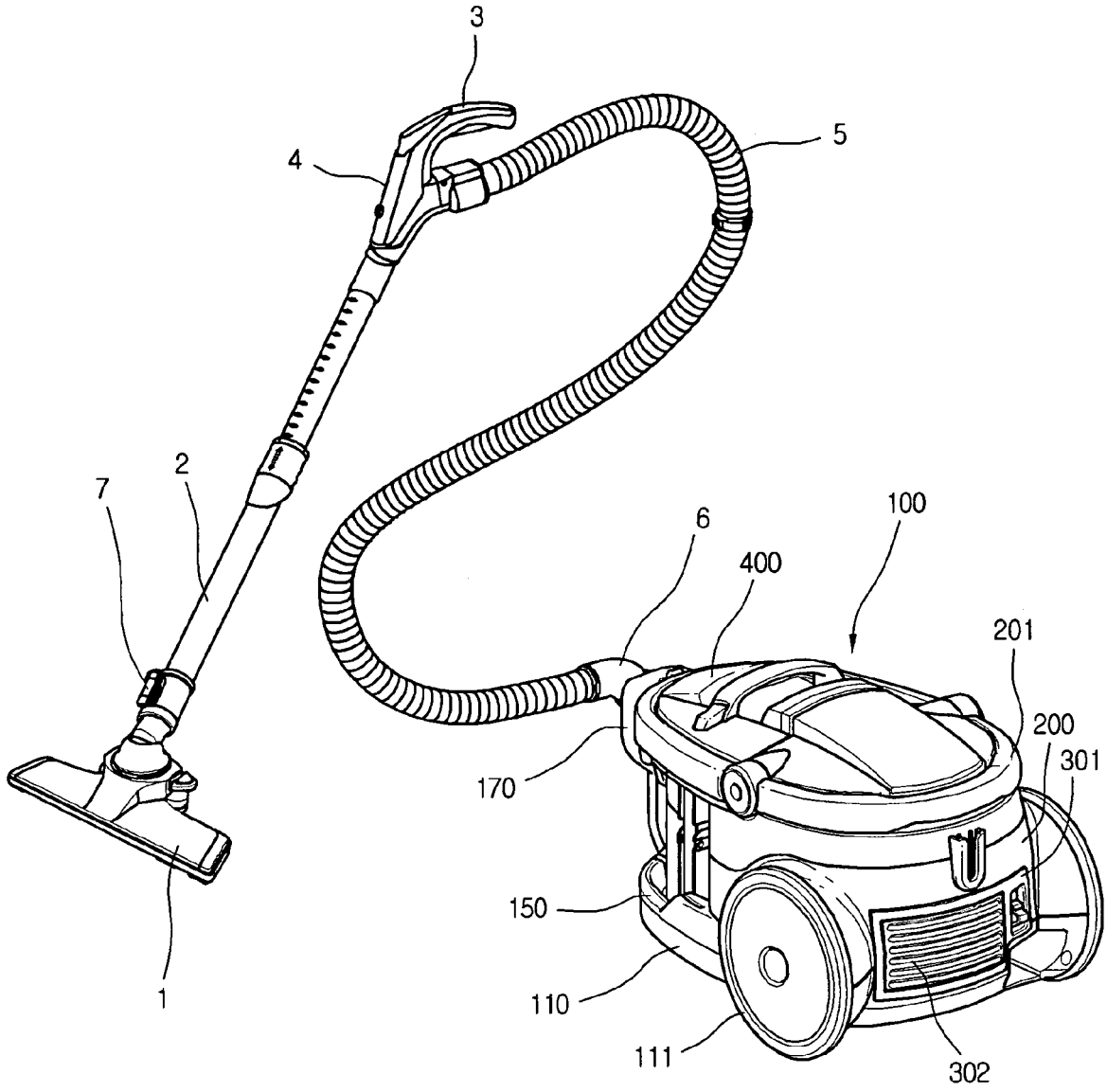
FIG. 1 is a perspective view of a vacuum cleaner where a dust collection unit of the present invention can be employed.

FIG. 1 shows a vacuum cleaner to which a dust collection unit according to the present invention can be applied.

Referring to FIG. 1, a vacuum cleaner includes a main body 100 and a suction assembly connected to a suction portion through which outer air is sucked into the main body 100. Disposed in the main body 100 are a motor (not shown), a suction fan (not shown), and a dust collection unit (not shown). Therefore, the sucked air is exhausted out of the main body 100 after foreign objects contained in the sucked air are filtered.

The suction assembly is provided to suck the air containing the foreign objects when sucking force is generated in the main body 100. That is, the suction assembly includes a sucking nozzle body 1 for sucking the air containing the foreign objects using a powerful airflow, an expandable tube 2 extending from the sucking nozzle body 1 and expandable and contractible by a user, an operation handle 3 provided on a distal end of the expandable tube 2, a manipulation unit 4 provided on a front portion of the operation handle 3, a flexible tube 5 extending from the operation handle 2, a connector 6 connecting a distal end of the flexible tube 5 to the main body 100, a pipe rest 7 on which the expandable pipe 2 can be supported and suspended when the vacuum cleaner is not used.

The connector 6 functions as a connection terminal transmitting a manipulation signal inputted by the user through the manipulation unit 4 to the main body 100 as well as a passage through which the sucked air is introduced into the main body 100. That is, a plurality of electric connection terminals are provided on a proximal end of the connector 6. However, the electric connection terminals are required only when the manipulation unit 4 is provided on the suction assembly. That is, when the manipulation unit 4 is provided on the main body 100, the electric connection terminals are not provided on the connector 6. In this case, the connector 6 may simply function as an air introducing passage.

The air introduced into the main body 100 through the suction assembly is exhausted out of the main body 100 after the foreign objects contained in the introduced air are filtered. The main body 100 of the vacuum cleaner will be described in more detail hereinafter with reference to FIGS. 1 and 2.

Figure 2:
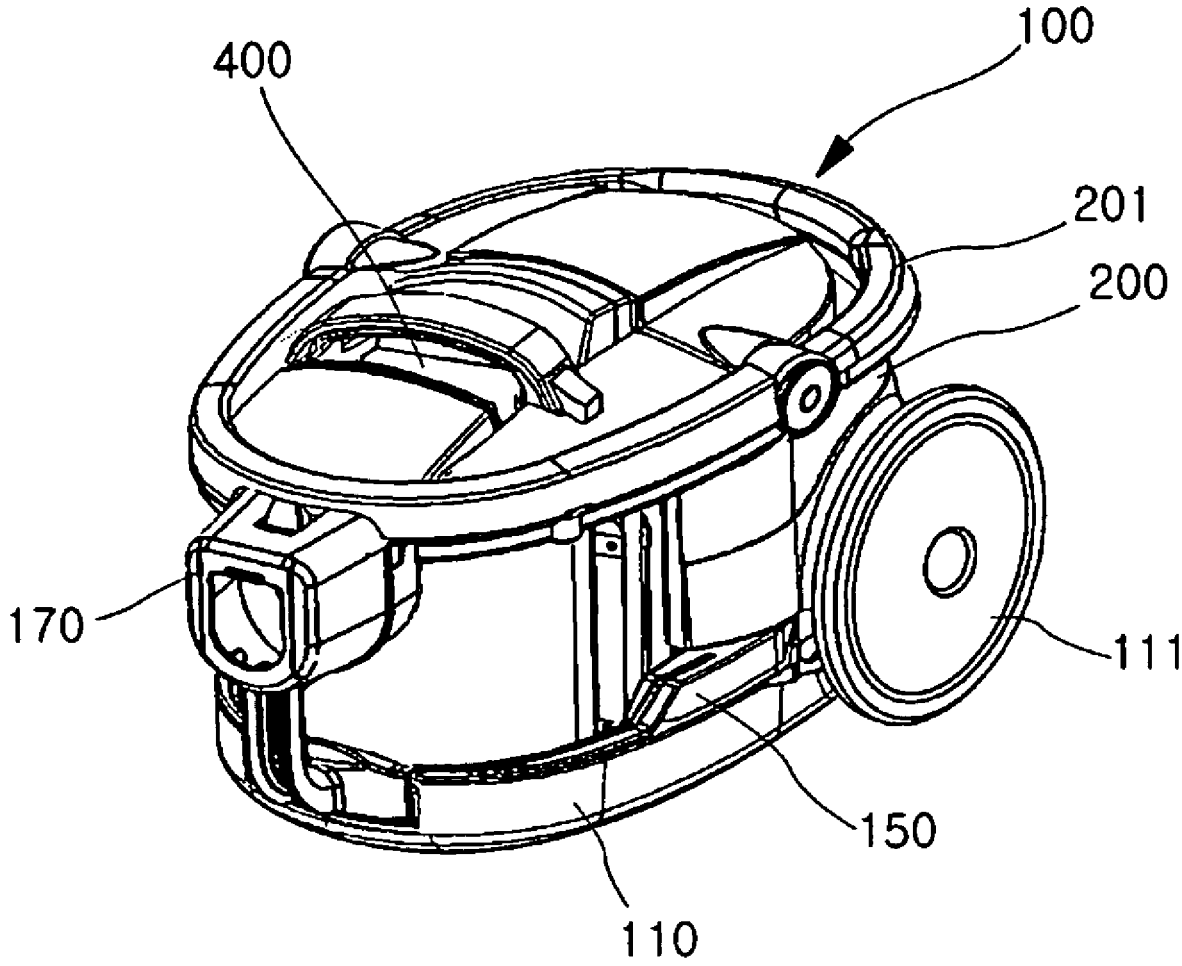
FIG. 2 is a front perspective of a vacuum cleaner depicted in FIG. 1.

FIG. 2 shows the main body of the vacuum cleaner.

Referring to FIGS. 1 and 2, the main body 100 includes a first base 110 defining a lower portion of the main body 100, a second base 150 disposed on the first base 110, a cover 200 disposed on the second base 150, wheels 111 provided on both rear-side portions of the cover 200 to make it easy to move the main body 100, and a front support 70 for supportably fixing the cover 200 and the first and second bases 110 and 150.

The connector 6 is connected to the front support 170 to allow the outer air to be introduced into the main body 100. The support 170 is designed to support the cover 200 and the first and second bases 110 and 150, thereby securely supporting the front portion of the main body 100.

The second base 150 is provided right above the first base 110 to improve the ornament of the main body and enhance the rigidity of the lower portion of the main body.

An exhaust cover 301 provided with a plurality of exhaust holes 302 is provided on a rear portion of the cover 200 to exhaust clean air. A carrying handle 201 is pivotally provided on a top surface of the cover 200. When a user intends to carry the main body 100, the user pivots the carrying handle 201 in a vertical position and conveniently carries the main body 100 with his/her hand grasping the carrying handle 201.

A dust collection unit 400 is disposed in the main body in rear of the front support 170 and a cyclone member (not shown) is received in the dust collection unit to generate cyclone airflows and filter the foreign object contained in the air.

Figure 3:
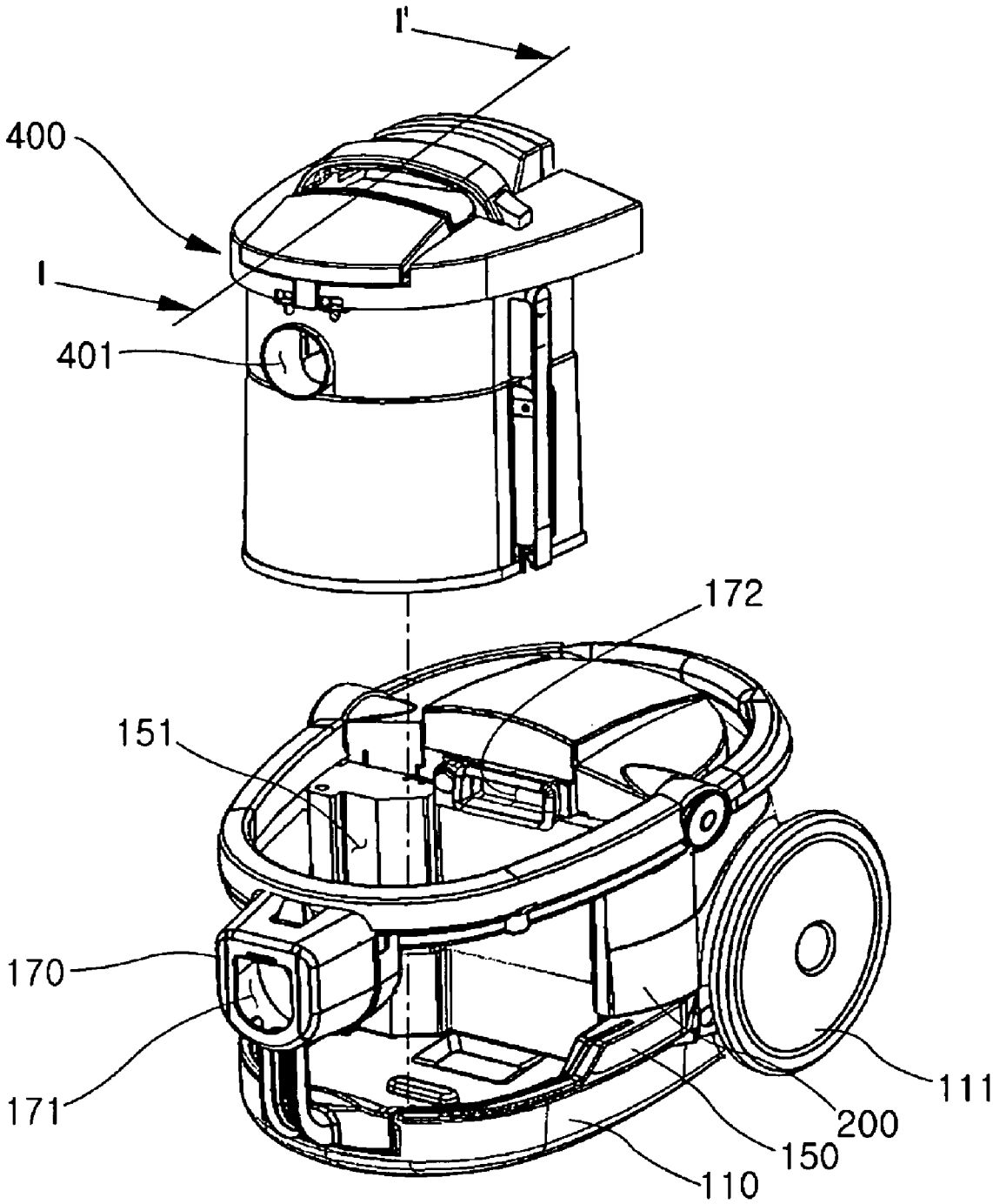
FIG. 3 is a perspective view illustrating a vacuum cleaner and a dust collection unit according to an embodiment of the present invention, which is separated from the vacuum cleaner.

As shown in FIG. 3, the dust collection unit 400 is vertically installed in and separated from a receiving chamber 151 defined in the main body 100. That is, the dust collection unit 400 may be installed in the receiving chamber 151 by being pushed downward and separated from the receiving chamber 151 by being pulled upward.

The front support 170 is provided with a first air intake hole 171 and the dust collection unit 400 is provided with a second air intake hole 401 corresponding to the first air intake hole 171. The dust collection nit 400 is further provided with an exhaust hole (not shown) opposite to the second air intake hole 401. The exhaust hole is aligned with a third air intake hole 172 formed toward the motor so that the air cleaned by passing through the collection unit 400 is exhausted toward the motor side.

Particularly, the third air intake hole 172 is formed in a rectangular shape lengthwise in a horizontal direction so as to reduce the size of the main body 100 and allow the air to effectively flow.

Figure 4:
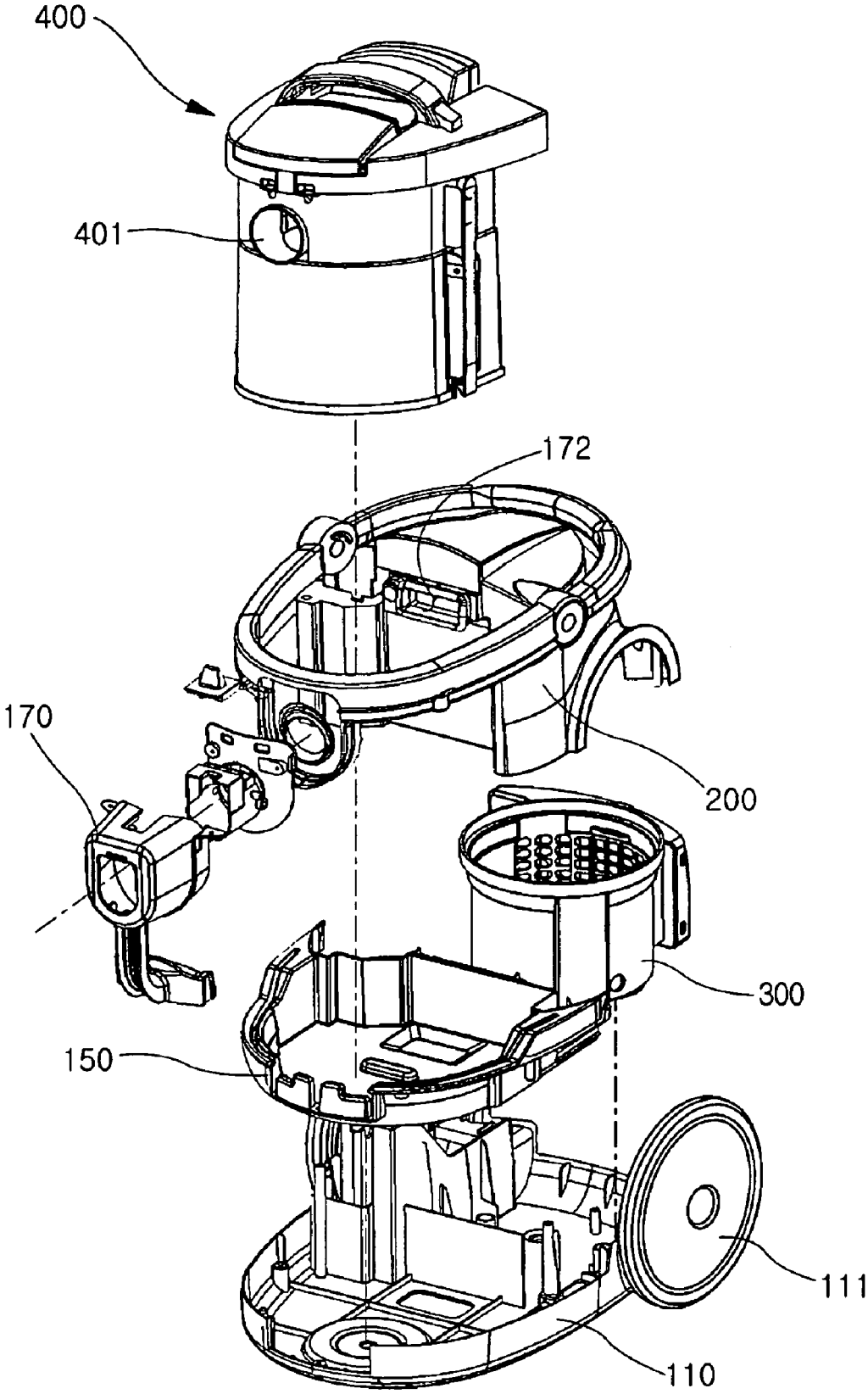
FIG. 4 is an exploded perspective view of a main body of a vacuum cleaner where a dust collection unit according to an embodiment of the present invention is employed.

FIG. 4 shows the main body of the vacuum cleaner.

Referring to FIG. 4, the second base 150 is disposed on a rear-top portion of the first base 110. A motor housing 300 is disposed on a rear portion of the first base 110. Then, the cover 200 is coupled to the first and second bases 110 and 150 to define the main body 100.

Here, the cover 200 is coupled to the first and second bases 110 and 150 in a state where the front support 170 is coupled to the cover 200. A flowing direction of the air introduced into the motor housing 300 through the third air intake hole 172 is changed by 90° in a vertical direction and is then changed in a horizontal direction so that the air can be exhausted rearward.

Figure 5:
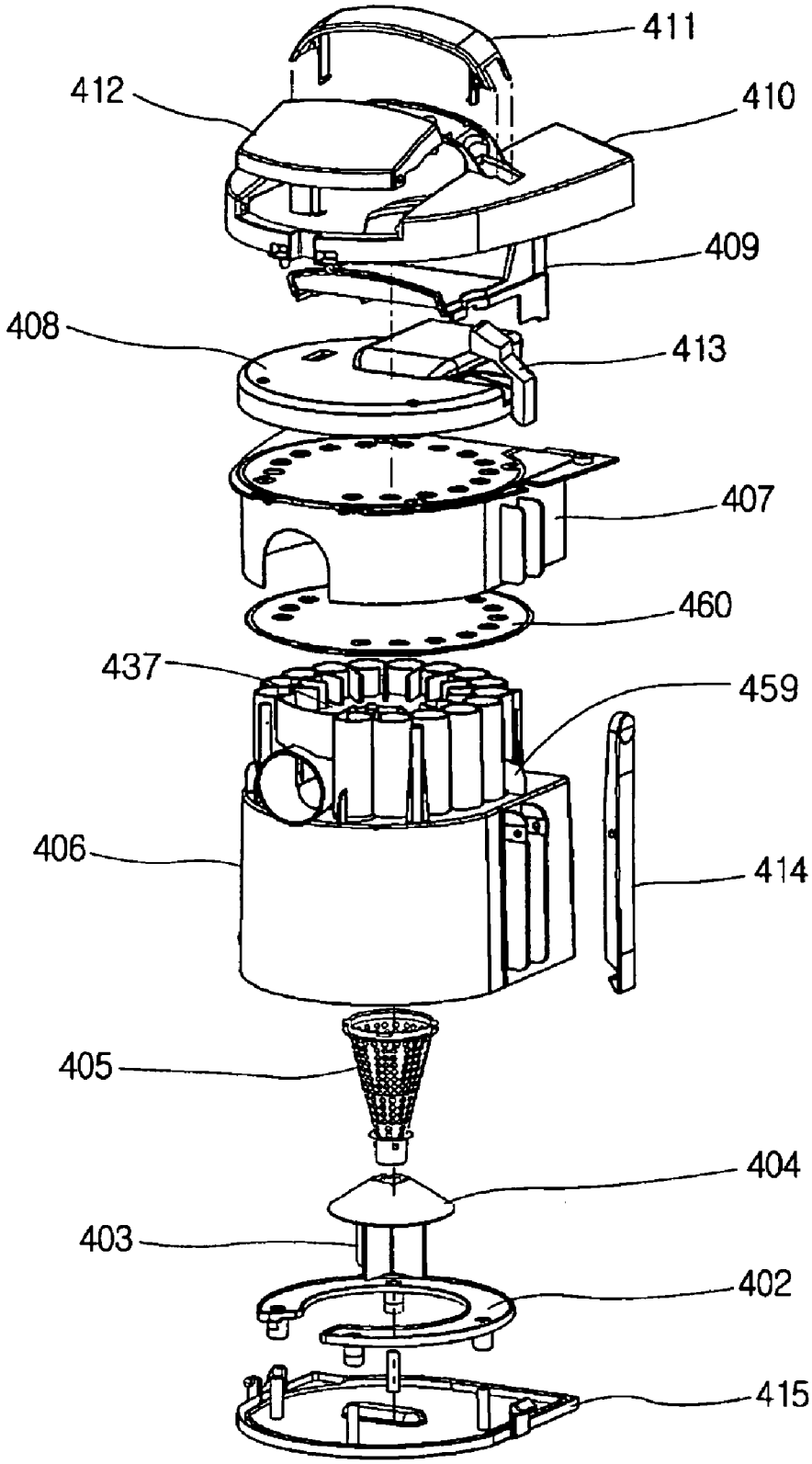
FIG. 5 is an exploded perspective view of a dust collection unit depicted in FIG. 4.

FIG. 5 shows the dust collection unit according to an embodiment of the present invention.

Referring to FIG. 5, the inventive dust collection unit 400 does not use a porous filter such as a sponge. That is, the inventive dust collection unit 400 is designed to filter the foreign objects using cyclone airflows. The cyclone airflow is generated at least two chambers separated from each other so that even the micro-scale dusts contained in the air can be filtered. This will be described in more detail hereinafter.

The dust collection unit 400 includes a collection body 406 provided with a plurality of filtering chambers (refer to the reference numerals 423 and 424 of FIG. 6) for filtering the foreign objects and a plurality of storing chambers (refer to the reference numerals 417 and 416 of FIG. 6) for storing the filtered foreign objects, chamber seal members 402 and 415 provided to seal a bottom of the collection body 406 and prevent the foreign objects stored in the storing chambers 416 and 417 from leaking, an air exhaust member 407 disposed on the collection body 406 to guide the flow of the air exhausted from the collection body 406, a gap forming member 408 providing a predetermined gap above the exhaust member 407 to allow the air exhausted from the exhaust member 407 to flow in a direction, and a cover assembly disposed on the gap forming member 408.

The cover assembly includes a first cover 410 functioning as a main body of the cover assembly, second and third covers 409 and 412 respectively disposed in rear and front of the first cover 410, a cover fixing member 411 fixing the first and second covers 410 and 409. The cover fixing member 411 is designed to cover a portion of the first cover 410 to improve the outer appearance while simultaneously fixing the first and second covers 410 and 409.

Disposed in the dust collection body 406 are a cone-shaped filter 405 and a blocking member 404 and airflow preventing plates 403. The cone-shaped filter 405 is provided to effectively filter the foreign objects when the cyclone airflows are generated. The blocking member 404 is disposed under the cone-shaped filter 405 to prevent the collected foreign objects from flying. The airflow preventing plates 403 are formed under the blocking member 404 to lower the airflow rate and to thereby allow the foreign objects to sink to the bottoms of the foreign object storing chambers. The airflow preventing plates 403 and the blocking member 404 may be integrally formed with each other while the cone-shaped filter 405 may be provided as a separated part that may be fitted on the cone-shaped filter 405.

In addition, an opening/closing button 413 is provided on the first cover 410 and an opening/closing lever 414 having a first end contacting the opening/closing button 413 to pivot when the opening/closing button 413 is pushed. The opening/closing lever 414 has a second end contacting the first chamber seal member 415. Therefore, when the opening/closing lever 414 is pushed, the opening/closing lever 414 pivots around a predetermined hinge point. When the second end of the opening/closing lever 414 moves away from the first chamber seal member 415, the first chamber seal member 415 rotates around a hinge point by its self-gravity and the foreign objects collected in the storing chambers 416 and 417 settled by their self-gravities.

In addition, the chamber seal members 415 and 402 are designed to respectively seal the bottoms of the foreign object storing chambers 415 and 416. The first chamber seal member 415 is hinge-coupled to the collection body 406 so that it can be opened by a pivotal motion when it is intended to throw away the foreign objects stored in the first chamber seal member 415. A separation plate 437 for separating the first and second filtering chambers 423 and 424 from each other and defining an air passage is provided on a top surface of the collection body 406.

A plurality of guide ribs 459 are formed on an outer circumference of the collection body 406 to guide the insertion of the exhaust member 407 around the collection body 406. Each of the guide ribs 459 is gently rounded at an upper corner to effectively guide the insertion.

In addition, the second filtering chambers 424 are formed on an upper surface of the collection body 406 and extend downward from the exhaust member 407 and the exhaust side air intake hole 425 extends in a tub-shape and is received in the second filtering chambers 424. Therefore, the air whose foreign objects are filtered by small cyclone airflows generated in the second filtering chambers 424 flows into the exhaust side air intake hole 425 having a relatively small diameter.

At this point, due to the diameter difference between the second filtering chamber 424 and the exhaust side air intake hole 425 as well as the high speed airflow, a bottleneck phenomenon for the airflow is incurred. That is, airflow speed in the exhaust side air intake hole 425 is steeply increased to 30 m/s, the air turbulence becomes more severed.

Due to the increased airflow speed and the severed air turbulence, high frequency noise is generated. Thus, to reduce such noise, a rectifying unit (refer to the reference numeral 463 of FIG. 7) for rectifying the airflow is provided in the exhaust side air intake hole 425. Since the rectifying unit 463 suppresses the air turbulence, the high frequency noise can be reduced.

The internal structure and operation of the dust collection unit 400 will be described in more detail with reference to FIG. 6.

As described with reference to FIG. 5, the dust collection unit 400 includes the collection body 406, the chamber sealing members 402 and 415 provided to selectively seal the bottom of the collection body 406, the cone-shape filter 405 received in the collection body 406 to enhance the dust collection efficiency, the blocking member 404 preventing the foreign objects stored in the collection body 406 from flying, the airflow preventing plates 403 for lowering the airflow rate and for thereby allowing the foreign objects to sink to the bottoms of the foreign object storing chambers, the air exhaust member 407 disposed on the collection body 406 to guide the flow of the air exhausted from the collection body 406, the gap forming member 408 providing a predetermined gap above the exhaust member 407 to allow the air exhausted from the exhaust member 407 to flow in a direction, and covers 409, 410, 411, and 412 disposed on the gap forming member 408.

The collection body 406 includes the outer wall 418, the intermediate wall 419 and the inner wall 420. The outer wall 418 and the intermediate wall 419 are not formed on the portion where the second air intake hole 401 is formed, thereby allowing the air to be effectively introduced.

A space defined between the outer wall 418 and the intermediate wall 419 becomes the first storing chamber 416 and a space defined between the intermediate wall 419 and the inner wall 420 becomes the second storing chamber 417. An inner space defined by the inner wall 420 becomes the first filtering chamber 423. However, the functions of the spaces vary according to the shape of the dust correction unit 400.

The operation of the above-described dust collection unit will be described hereinafter with reference to the airflow.

The air is first introduced into the dust collection unit 400 through the second air intake hole 401. Here, an outer end of the second air intake hole 401 communicates with the front support 170 and an inner end of the second air intake hole 401 communicates with the first filtering chamber 423. A first air introduction guide 421 is projected inward from a portion of the inner wall 420, which defines the inner end of the second air intake hole 401, to guide the air in an inner circumferential direction of the first filtering chamber 423.

When the cyclone airflow is generated in the first filtering chamber 423, the foreign objects contained in the air are settled and the cleaned air is exhausted upward through the apertures of the cone-shaped filter 405. The second air exhaust hole 401 is formed corresponding to an upper portion of the cone-shaped filter 405, a relatively high RPM cyclone airflow is generated at the upper portion of the cone-shaped filter 405 and a relatively low RPM cyclone airflow is generated at a lower portion of the cone-shaped filter 405. This is the reason for forming the filter 405 in the cone-shape. That is, since a large amount of the foreign objects are forced outward in the relatively high RPM cyclone airflow and a large amount of the foreign objects are forced in the relatively low RPM cyclone airflow, it is preferable that the filter 405 is formed in the cone-shape.

The cone-shaped filter 405 may be detachably seated on a center of the separation plate 437 defining a top wall of the first filtering chamber 423. The cone-shaped filter 405 is typically provided with a plurality of pores through which the air passes.

The blocking member 404 is disposed under the cone-shaped filter 405 to prevent the settled foreign objects from flying. The blocking member 404 has a diameter that is increased as it goes downward to prevent the foreign objects from flying in a reverse direction. The airflow preventing plates are disposed under the blocking member 404 at a predetermined gap to prevent the cyclone airflow from reaching the settled foreign objects, thereby basically preventing the settled foreign objects from flying.

A coupling relationship between the cone-shaped filter 405, the blocking member 404, and the airflow preventing plate 403 will be described hereinafter in more detail.

In addition, the foreign objects filtered in the first filtering chamber 423 are stored in the first storing chamber 416 formed under the first filtering chamber 423. A bottom of the first storing chamber 416 is sealed by the first sealing member 415. The air introduced passes through the first filtering chamber 423, in the course of which the relatively large-sized foreign objects contained therein are filtered, and is then directed to the separation plate 437 through the cone-shaped filter 405. Therefore, in order to filter micro-scale foreign objects, additional cyclone airflow is further required. This will be described in more detail hereinafter.

The air passing through the cone-shaped filter 405 is introduced into the second filtering chambers 424 through a second air introduction guide 422. Since the second air introduction guide 422 faces the inner circumference of the second filtering chambers 424 in a tangent direction, the cyclone airflow is generated in the second filtering chamber 424.

The foreign objects filtered in the second filtering chambers 424 by the cyclone airflow are settled in the second storing chamber 417. In order to prevent the settle foreign objects from flying, a width of each of the lower portion of the second filtering chambers 417 are narrowed. In addition, in order to prevent the settled foreign objects from leaking, a bottom of the second storing chamber 417 is sealed by the second chamber sealing member 402.

The second chamber sealing member 402 has a bar-shaped connection structure to be connected to the first chamber sealing member 415, thereby increasing an inner volume of the first storing chamber 416. That is, since the foreign objects are stored in the space defined between the lower end of the second chamber sealing member 402 and the upper end of the first chamber sealing member 415, it is preferable that the connection structure is formed in a bar-shape that can occupy a small space.

The air whose foreign objects are filtered in the second filtering chamber 424 is introduced into the exhaust member 407 via an exhaust side air intake hole 425 and collected in a space between the exhaust member 407 and the gap forming member 408. Here, a diameter of the exhaust side air intake hole 425 is less than an inner diameter of the second filtering chamber 424 so as to prevent the foreign objects in the second filtering chamber 424 from being directed to the exhaust member 407. That is, the foreign objects collected on the inner circumference of the second filtering chambers 424 are not exhausted through the exhaust side air intake hole 425.

Figure 7:
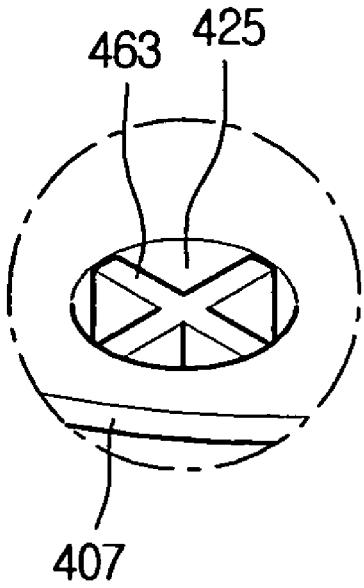
FIG. 7 is an enlarged view of a portion A in FIG. 5.

However, due to the diameter difference between the exhaust side air intake hole 425 and the second filtering chamber 424, the airflow speed is increased in the exhaust side air intake hole 425 and the air turbulence is generated. To rectify such airflow, the rectifying unit 463 is integrally formed with the tube defining the exhaust side air intake hole 425. The rectifying unit 463 is, as shown in FIG. 7, formed in a cross-shape. However, the present invention is not limited to this case. That is, it can be formed in a linear-shape or a radial-shape. The operation of the rectifying unit 463 will be described later.

Meanwhile, The air whose foreign objects are filtered in the first and second filtering chambers 423 and 424 by the cyclone airflows is directed to the motor and then exhausted through the rear surface of the main body 100.

Meanwhile, the cover assembly is further formed on an upper portion of the gap forming member 408. The cover assembly includes the first cover 410, the second and third covers 409 and 412 covering the rear and front portions of the fist cover 410, and the cover fixing member 411 fixing the second cover 409 to the first cover 410.

Figure 6:
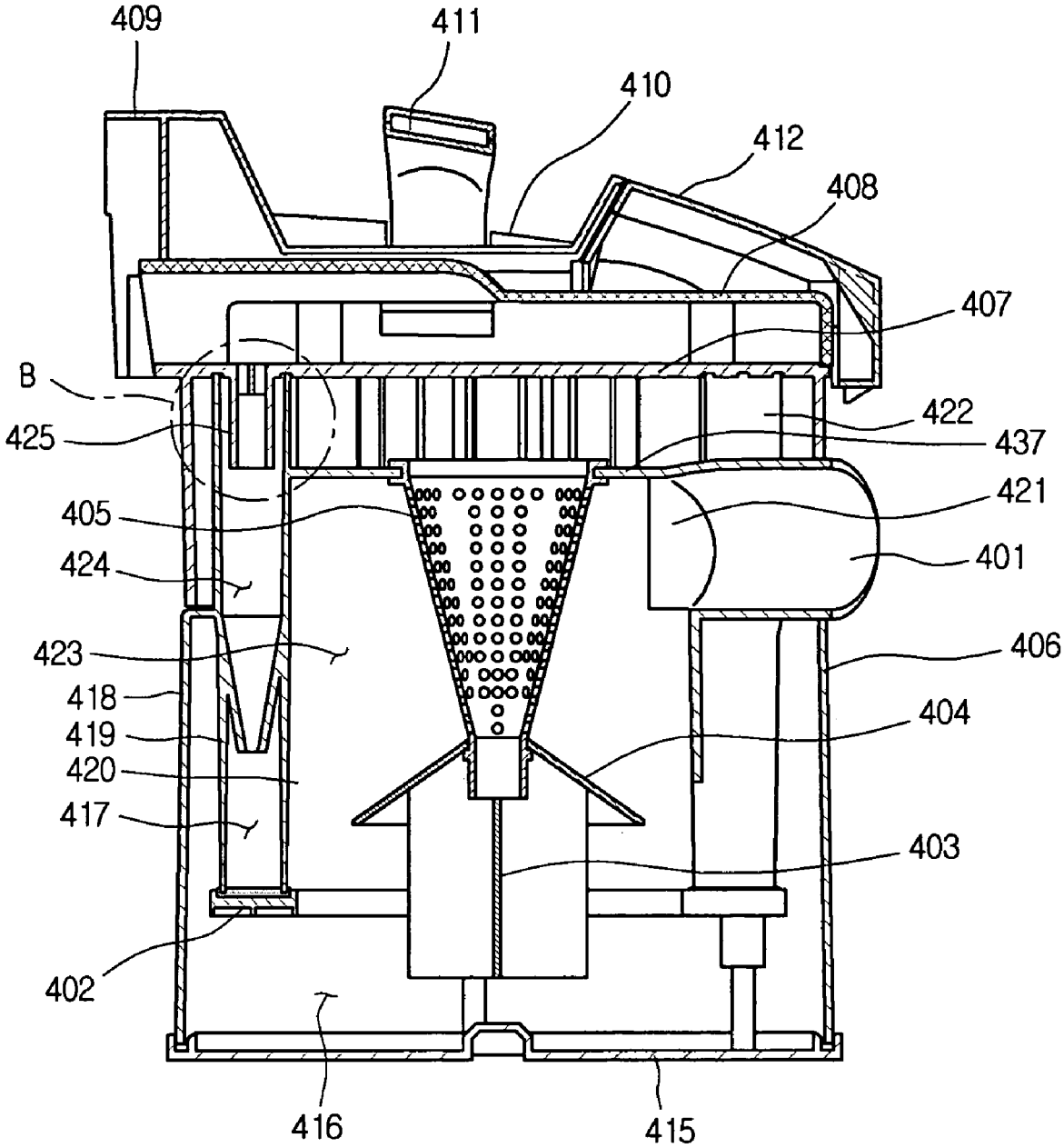
FIG. 6 is a sectional view taken along lines I-I' of FIG. 3.
Figure 8:
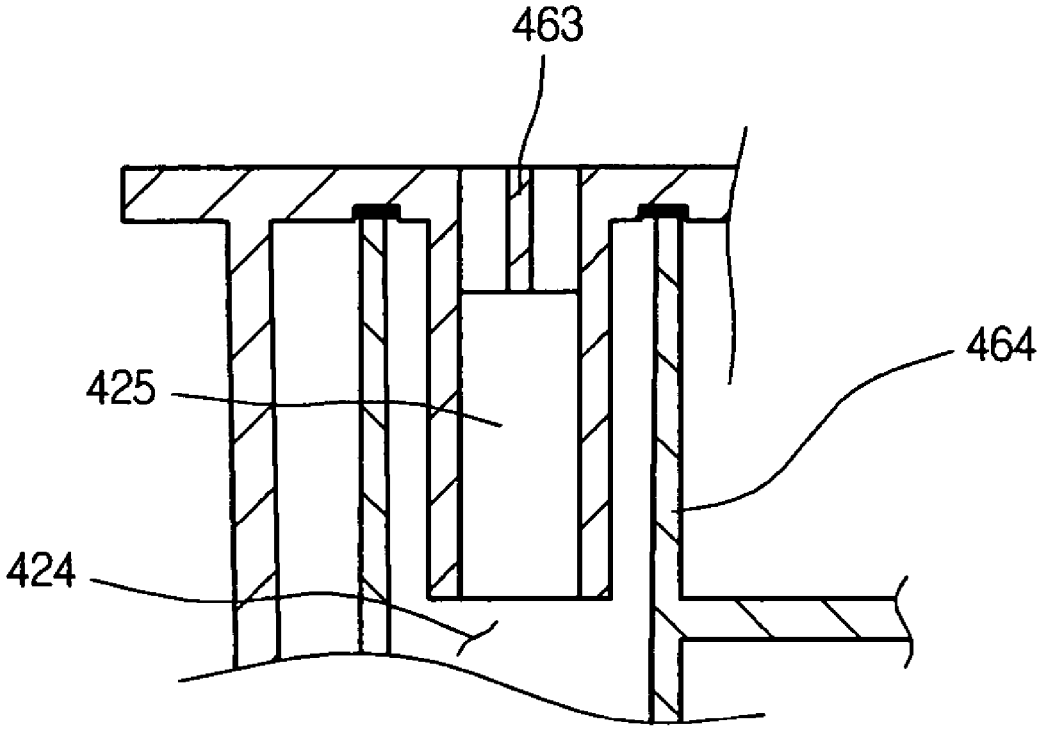
FIG. 8 is an enlarged view of a portion B in FIG. 6.

FIG. 7 is an enlarged view of a portion A of FIG. 5 while FIG. 8 is an enlarged view of a portion B of FIG. 6.

Referring to FIGS. 7 and 8, there is shown the second filtering chamber 424 and the exhaust side air intake hole 425 inserted to a predetermined depth into the second filtering chamber 424. An inner circumference of the second filtering chambers 424 are distance from an outer circumference of the exhaust side air intake hole 425. As a result, airflow speed of the air exhausted through the exhaust side air intake hole 425 is increased as compared with that in the second filtering chambers 424, thereby further enhancing the foreign object removal efficiency.

However, as the diameter of the exhaust side air intake hole 425 is reduced, the airflow speed of the air passing through the exhaust side air intake hole 425 is further increased and the air turbulence becomes more severed, thereby increasing the noise. Thus, in order to reduce the noise by eliminating the air turbulence phenomenon for the airflow, the rectifying unit 463 formed in the cross-shape is provided in the exhaust side air intake hole 425. By the rectifying unit 463, the air turbulence component in the exhaust side air intake hole 425 can be sufficiently eliminated.

When the air turbulence component for the airflow is eliminated, the noise is reduced.

The shape of the rectifying unit is not limited to the cross-shape. That is, it can be formed in a linear-shape or a radial-shape. In addition, when the number of plates forming the rectifying unit 463 is increased, the high frequency noise reduction effect can be further improved. However, when the number of plates is excessively increased, the area of the exhaust side air intake hole 425 is undesirably reduced.

Describing the noise reduction effect in another aspect, since the kinetic energy of the air turbulence for the airflow is reduced by the rectifying unit 463, the noise is reduced.

Meanwhile, the rectifying unit 463 may be integrally formed with the exhaust member 407 or may be separately prepared and coupled to the exhaust member 407.

Figure 9:
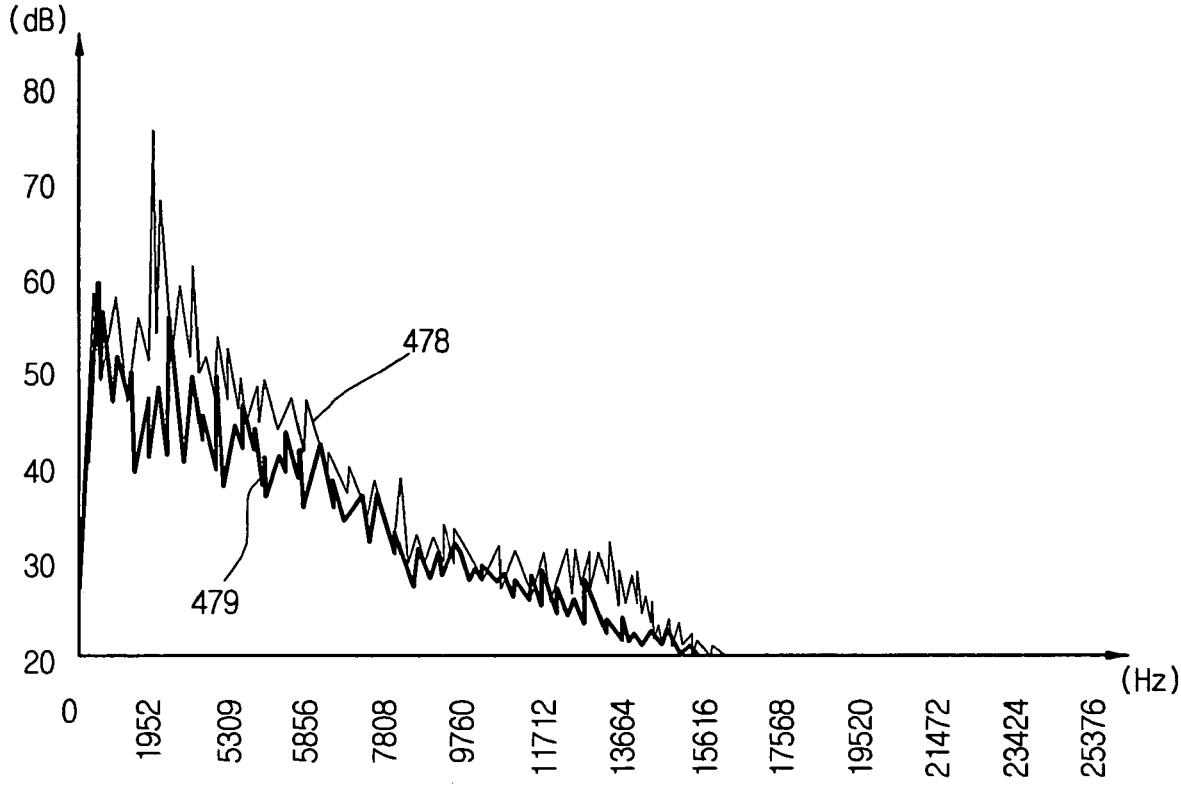
FIG. 9 is a graph comparing noises generated when a rectifying unit is installed and is not installed.

FIG. 9 shows a graph comparing noises generated before and after the rectifying unit is installed under identical conditions. The test was done using the cross-shaped rectifying unit.

Referring to FIG. 9, a curve 1(478) is a noise value curve before the rectifying unit is installed while a curve 2(463) is a noise value curve after the rectifying unit is installed. From the curves, it can be noted that the noise at each frequency is reduced after the rectifying unit 463 is installed.

The operation of the above-described dust collection unit 400 and the overall operation of the main body 100 of the vacuum cleaner will be described hereinafter with reference to FIG. 10.

Figure 10:
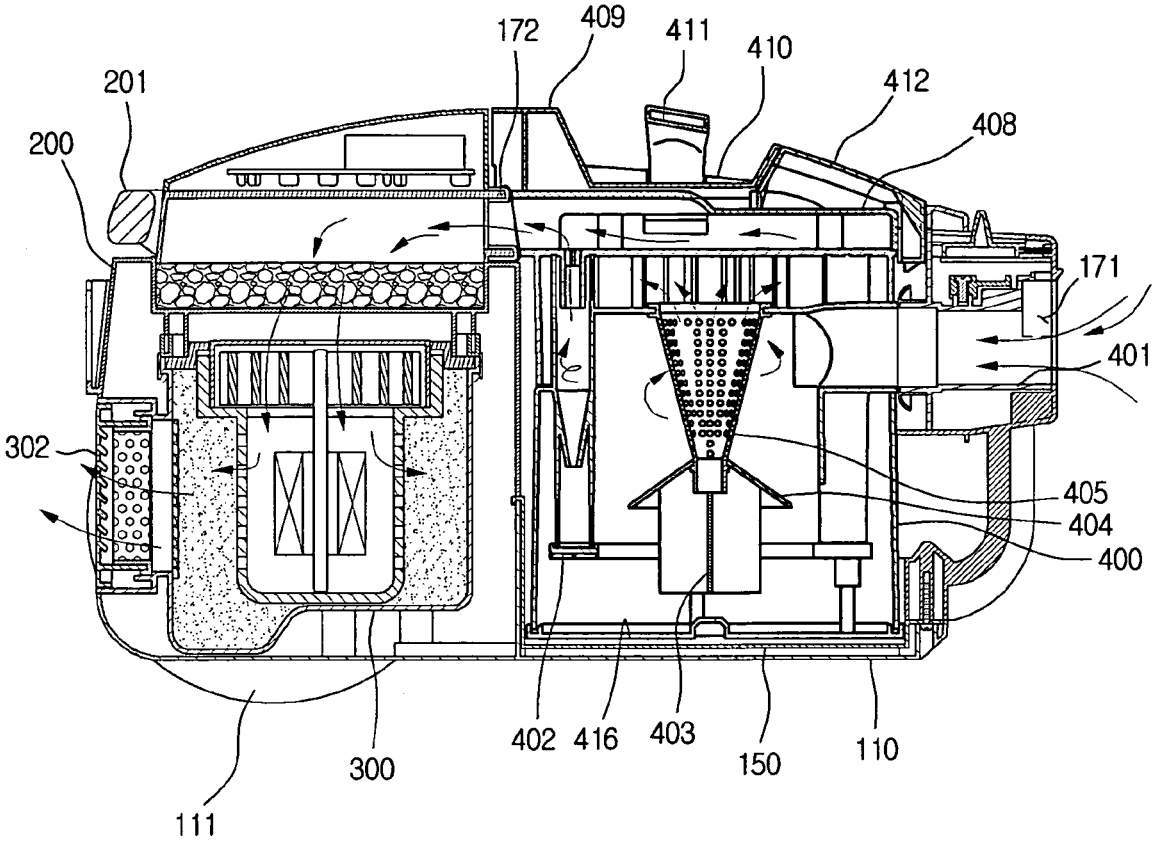
FIG. 10 is a longitudinal sectional view of a vacuum cleaner where a dust collection unit of the present invention is applied.

Referring to FIG. 10, outer air is introduced into the main body 100 through the air intake hole 171 of the main body 100 and is then introduced into the dust collection unit 400 through the air intake hole of the dust collection unit. The foreign objects contained in the air is filtered in the dust collection unit 400 as described above and is then introduced into the motor housing 300 in a horizontal direction.

The air introduced into the motor housing 300 in the horizontal direction moves downward to be exhausted through the exhaust holes 302 formed on the rear surface of the main body 100.

According to the present invention, an effect for reducing the high frequency noise in the dust collection unit can be obtained.

As described above, the shape of the rectifying unit is not limited to the cross-shape. That is, it can be formed in a linear-shape, a radial-shape where a plurality of plates extend in a radial direction, a rectangular lattice-shape, a circular-shape, or an oval-shape.

In the above-described embodiment, although the rectifying unit 463 has an identical section extending in a vertical direction, the present invention is not limited to this. That is, the section may be formed in a spiral-shape or other curved-shape. However, when the shape of the rectifying unit is complicated, the molding process is undesirably complicated and the airflow resistance is undesirably increased. Therefore, it is preferable that the shape of the rectifying unit 463 is modified within the limits where the airflow resistance is not remarkably increased.

In addition, in the above-described embodiment, although the rectifying unit 463 is provided in an outlet of the exhaust side air intake hole 425, the present invention is not limited to this. That is, the rectifying unit 463 may be provided on any place in the passage defining the exhaust side air intake hole 425.

A depth of the rectifying unit 463 may vary according to the specification of the dust collection unit. It is preferable that the vertical length (depth) of the rectifying unit is increased as the airflow speed is increased.

When there is no exhaust side air intake hole by varying the structure of the dust collection unit, the rectifying unit 463 may be provided in the second filtering chamber to reduce the noise.

According to the present invention, the noise generated by the airflow during the operation of the dust collection unit can be reduced and the user's unpleasant sensation can be attenuated.

In addition, since the rectifying unit can provide noise reduction effect even when a plurality of cyclone airflows are generated, the user's satisfaction for the multi-cyclone dust collection unit can be improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dust collection unit for a vacuum cleaner, comprising:

a filtering chamber filtering foreign objects;

an exhaust member disposed above the filtering chamber to guide airflow and having a tube located in an exhaust side of the filtering chamber, the tube defining an exhaust side air intake hole;

a storing chamber disposed under the filtering chamber to store the foreign objects filtered in the filtering chamber;

a sealing member sealing bottoms of the filtering chamber; and a rectifying unit integrally formed with an inner periphery of the tube to rectify airflow, thereby reducing noise generated by the airflow.

2. The dust collection unit according to claim 1, wherein the rectifying unit is provided at an outlet side of the tube.

3. The dust collection unit according to claim 2, wherein the exhaust side air intake hole extends downward from the exhaust member.

4. The dust collection unit according to claim 2, wherein an outer diameter of the exhaust side air intake hole is less than an inner diameter of the filtering chamber.

5. The dust collection unit according to claim 1, wherein the rectifying unit has a section having a shape selected from the group consisting of a cross-shape, a linear-shape, a radial-shape, a circular-shape, and a lattice-shape.

6. The dust collection unit according to claim 1, further comprising a gap forming member disposed above the exhaust member to guide airflow exhausted through the rectifying unit.

7. The dust collection unit according to claim 1, wherein the rectifying unit extends in an extending direction of the filtering chamber.

8. The dust collection unit according to claim 1, wherein the rectifying unit has an identical section shape extending in an extending direction of the second filtering chamber.

9. A dust collection unit for a vacuum cleaner, comprising:

a first filtering chamber filtering relatively large foreign objects;

a second filtering chamber filtering relatively small foreign objects when air exhausted from the first filtering chamber is introduced into the second filtering chamber;

an exhaust member to guide the flow of the air exhausted from the second filtering chamber and having a tube located in an exhaust side of the second filtering chamber, the tube defining an exhaust side air intake hole; and a rectifying unit integrally formed with an inner periphery of the tube to rectify airflow, thereby reducing noise generated by the airflow.

10. The dust collection unit according to claim 9, wherein the rectifying unit is provided at an outlet side of the tube.

11. The dust collection unit according to claim 9, wherein the rectifying unit has a section having a cross-shape.

12. The dust collection unit according to claim 9, wherein the second filtering chamber is provided in plurality disposed around the first filtering chamber.

13. A dust collection unit for a vacuum cleaner, comprising:

a filtering chamber filtering foreign objects;

an exhaust member to guide airflow of the filtering chamber and having a tube located in an exhaust side of the filtering chamber, the tube defining an exhaust side air intake hole; and a rectifying unit integrally formed with an inner periphery of the tube to rectify airflow, thereby reducing noise generated by the airflow.

14. The dust collection unit according to claim 13, wherein the air whose foreign objects are filtered in the filtering chambers is exhausted upward.

15. The dust collection unit according to claim 13, further comprising a gap forming member disposed above the exhaust member to guide air exhausted through the rectifying unit.

16. The dust collection unit according to claim 13, wherein the rectifying unit is provided at an outlet side of the tube.

* * * * *